United States Patent [19]

Stiernspetz

[11] 4,318,484

[45] Mar. 9, 1982

[54] DEVICE FOR SORTING OUT INDIVIDUAL ARTICLES WHICH DIFFER FROM THE MAIN QUANTITY IN A CONSECUTIVE FEEDOUT

[75] Inventor: Allan Stiernspetz, Björkö Nykil, Sweden

[73] Assignee: Datasaab AB, Jarfalla, Sweden

[21] Appl. No.: 147,012

[22] Filed: May 6, 1980

[30] Foreign Application Priority Data

May 8, 1979 [SE] Sweden ..... 7904032

[51] Int. Cl.[3] ..... G07D 1/00; G07D 9/00

[52] U.S. Cl. ..... 209/534; 209/551; 194/4 E; 271/184; 271/225

[58] Field of Search ..... 209/534, 551, 552, 569, 209/583, 584, 618, 900; 194/4 C, 4 E, 4 R, DIG. 9, DIG. 26; 271/184, 225

[56] References Cited

U.S. PATENT DOCUMENTS

| | | | |
|---|---|---|---|
| 3,273,886 | 9/1966 | Taylor, Jr. | 271/225 |
| 3,590,992 | 7/1971 | Soderetrom | 209/534 |
| 3,706,374 | 12/1972 | Ptacek | 209/534 |
| 3,765,523 | 10/1973 | Nakanishi | 209/534 X |
| 3,850,299 | 11/1974 | Kreitzer | 209/534 X |
| 4,179,685 | 12/1979 | O'Maley | 209/534 X |

*Primary Examiner*—Allen N. Knowles

*Attorney, Agent, or Firm*—Sughrue, Mion, Zinn, Macpeak and Seas

[57] ABSTRACT

A device for sorting out individual articles which differ from the main quantity in a consecutive feedout. Articles to be conveyed in response to specific conditions, for example monetary bills which are to be discharged individually and which are to face the same direction, are supplied to a nip between a pair of rollers, with the axes of said rollers being disposed in a plane forming an acute angle to the path of conveyance through the rollers. The articles are sensed individually after passing said rollers, and if the specific condition is not fulfilled the direction of rotation of the rollers is reversed, whereby the differing articles (bills) are returned towards the place where they originally entered the nip but are conveyed down below a shield which they have passed over in their previous conveyance. The rejected articles are collected after having passed below the shield.

5 Claims, 2 Drawing Figures

DEVICE FOR SORTING OUT INDIVIDUAL ARTICLES WHICH DIFFER FROM THE MAIN QUANTITY IN A CONSECUTIVE FEEDOUT

BACKGROUND OF THE INVENTION

1. Field of the Invention

This invention refers to a device for sorting out or rejecting individual articles having the form of for example paper sheets or bills differing from the main quantity in a consecutive feedout.

2. Description of the Prior Art

In a great number of applications in which articles having the form of sheets are to be discharged for use in an industrial or administrative process substantial requirements have to be met in respect of the discharged articles fulfilling certain conditions, wherein the articles are to be sorted out or rejected if they deviate from said conditions. This is particularly important when securities are handled, for example stocks, bonds, bills or the like.

Methods of counting discharged articles having the form of sheets in various manners are known in the prior art. Methods of distinguishing articles deviating from a given standard are also known.

SUMMARY OF THE INVENTION

However, the mentioned methods have proven to be not entirely reliable, and the present invention has the object of eliminating this disadvantage by disclosing a unique device for ensuring during a discharge process of articles, for example bills, not only that the articles are discharged solely in accordance with predetermined conditions, for example one at a time, but also that if an error occurs (two sheets or defective sheets, bills, etc.) said articles are rejected and are returned to a collecting place for faulty articles. The means by which the object which has been set forth are achieved are disclosed in the accompanying claims.

BRIEF DESCRIPTION OF THE DRAWINGS

The invention will be described more specifically below with reference to the accompanying drawing, in which.

Figure 1:
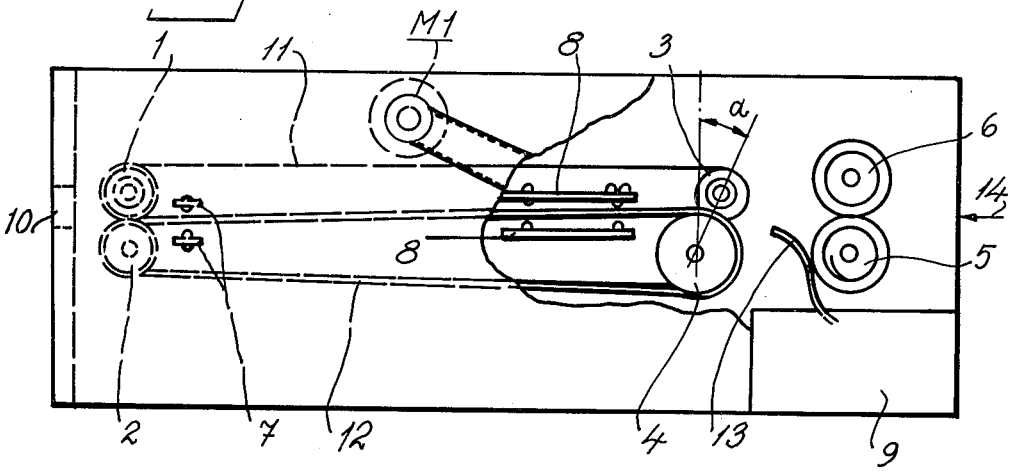
FIG. 1 shows a side view of a rejecting device for articles having the form of sheets designed in accordance with the invention and serving as an example and FIG. 2 illustrates the same device as viewed from above.
Figure 2:
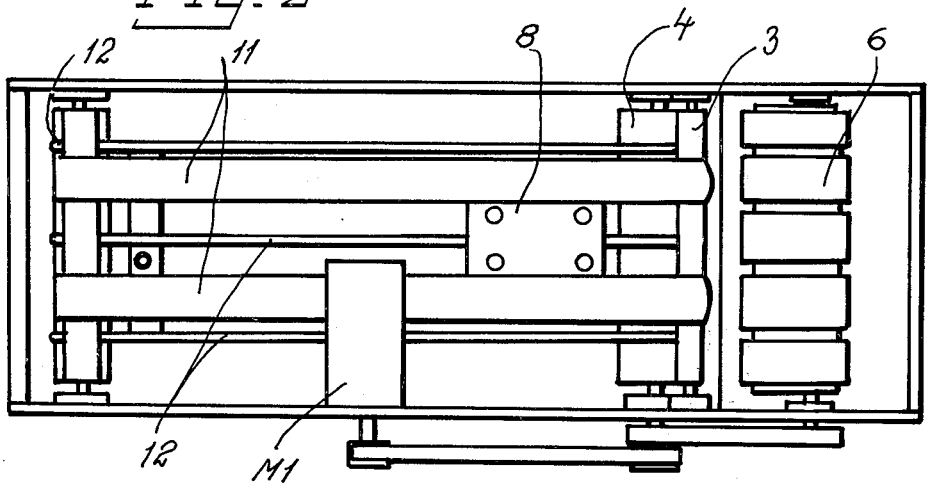

Part of the inside of the device is shown in FIG. 1, and consequently certain components included in FIG. 2 are missing in FIG. 1.

DESCRIPTION OF THE PREFERRED EMBODIMENT

The device illustrated by the figures includes a motor M1 which can drive rollers 3, 4, 5, and 6 over a transmission of any suitable conventional type. The device also includes two idler rollers 1 and 2, with a course consisting of two comparatively wide flat belts 11 and three round belts 12 running around rollers 1 and 2 on one hand and around rollers 3 and 4 on the other hand, said belts driving rollers 1 and 2.

A plate 13 which is bent to appropriate shape so that it may fulfil its purpose, which will be explained below, is associated with two cooperative feed and sorting rollers 5 and 6. A collecting box 9 is disposed below plate 13.

The above-mentioned belts run substantially parallel to each other, and they are arranged in such manner that the two flat belts 11 run over rollers 1 and 3 and are positioned above the three round belts 12 which run over rollers 2 and 4. When the device is observed from straight above the flat belts 11 will thus be disposed at a distance from each other at a higher level, whereas the round belts 12 are positioned such, that one of them runs centrally in the spacing between the two flat belts with the two other ones running one on each side of the two flat belts but at a lower level. In said spacing between the flat belts 11 there is positioned a sensor 8 having components located above and below, respectively, a plane which is common to the course of the flat belts and the round belts. At the end of this course there is located a monitoring sensor 7, the purpose of which will be described more specifically below.

The device operates in the following manner. The relevant articles, among which articles deviating from the main quantity are to be separated or rejected, are fed into the device in the feed-in direction illustrated by arrow 14 so as to be conveyed in between the feed roller 5 and the sorting roller 6, which forward the articles, which for example may consist of paper sheets, bills or the like, to the nip between rollers 3 and 4 so that continued conveyance is carried out by means of belts 11 and 12, as all four rollers 3, 4, 5, and 6 are driven by motor M1. Feed roller 5 is provided with rubber rings which fit into grooves in sorting roller 6. In FIG. 2 said rings are concealed by sorting roller 6.

As the article is conveyed forwardly in consequence of being clamped between the flat belts 11 and the round belts 12 said article passes between the two components of sensor 8, said sensor serving the purpose of ensuring that solely articles fulfilling the above-mentioned conditions be permitted to continue in the path. The number of accepted articles is counted sequentially by monitoring sensor 7.

If sensor 8 indicates that more than one article is located in the path or that the relevant article is defective this will cause motor M1 first to be stopped and then to be reversed. The revelant articles, for example paper sheets, bills, or the like, will then be fed rearwardly, and as in accordance with the invention rollers 3 and 4 are disposed such, that a plane through their center axes forms an angle $\alpha$ to the vertical, the tangent to the contact line between rollers 3 and 4 will be directed in such manner that the relevant article or the relevant articles when being conveyed rearwardly will be discharged downwardly below plate 13 to collecting box 9 or to some other storage means for defective or erroneously conveyed articles. The angle $\alpha$ may appropriately lie between 0° and 60° and it may preferably be 45°.

As is mentioned above, monitoring sensor 7 counts the number of discharged articles. Discharging the articles takes place at an outlet 10 as illustrated in FIG. 1. In addition to monitoring sensor 7 completing its purpose of counting the number of articles it supplies a pulse which initiates the conveyance of the next article unless sensor 8 has reacted. The procedure is repeated until the required number of articles has been discharged.

Sensor 8 may appropriately be based on the principle of optical translucency, for example utilizing infra-red light. In this connection, said sensor may have a plurality of translucency points in such positions that not all of these have solely dark sections simultaneously. In order that the sensor achieve the greatest possible sensitivity for different types of sheets the translucency points are set and finely adjusted automatically by built-in electronics on the basis of values determined for each individual sheet type.

I claim:

1. A device for sorting out individual articles in the form of sheets deviating from the main quantity of a consecutive feedout, said device comprising:

a first pair of cooperating rollers (5, 6), a second pair of cooperating rollers (3, 4), a third pair of cooperating rollers (1, 2), a first set of conveyor belts (11), a second set of conveyor belts (12), a stationary member (13), and a collecting box (9), the axes of the rollers in said first pair of cooperating rollers being disposed in a plane at right angles to a feed-in-plane for said articles through a nip formed between said rollers, the axes of the rollers in said second pair of rollers being disposed in a plane forming an acute angle to a plane disposed at right angles to the feed-in plane, the axes of the rollers in said third pair of cooperating rollers being diposed in a plane lying at right angles to a feedout plane for said articles through a nip formed between said rollers, said first set of conveyor belts passing around one roller in each of said second and third pairs of rollers, said second set of conveyor belts passing around a second roller in said second and third pairs of rollers, motor means drivably coupled to said first and second pairs of rollers with said first and second belts running partially in approximately a common plane, sensing means (8) controllably connected to said motor means and operatively disposed to sense articles conveyed between said first and second sets of conveyor belts in said common plane, said stationary member being located lower than said first pair of rollers and being shaped such that articles conveyed into the nip of said first pair of rollers and into the nip of said second pair of rollers for being passed between said sensing means will pass over said stationary member, whereas if said sensing means reject the relevant article and concurrently reverse the motor said article will be rejected by the direction of motion of the first and second sets of belts being reversed, thereby releasing the article for passing the latter below said stationary member, and said reversed articles being collected in said collecting box.

2. A device in accordance with claim 1, wherein said angle is an angle of between 0° and 60°.

3. A device in accordance with claim 1, wherein said angle is an angle of 45°.

4. A device in accordance with claim 1, wherein a monitoring device is disposed adjacent to the common paths of the first and second sets of belts for counting the number of particles permitted to pass through the device.

5. A device in accordance with claim 1, wherein said stationary member has the form of a faint "S".

* * * * *